United States Patent [19]

Zeppernick et al.

[11] 4,043,013

[45] Aug. 23, 1977

[54] TRANSFER ROLLER

[75] Inventors: Friedrich Zeppernick, Cologne; Klaus-Peter Dotzel, Bad Homburg, both of Germany

[73] Assignee: Firma Felix Bottcher, Cologne, Germany

[21] Appl. No.: 594,483

[22] Filed: July 9, 1975

[30] Foreign Application Priority Data

July 13, 1974 Germany ..... 2433749

[51] Int. Cl.[2] ..... B21B 31/08

[52] U.S. Cl. ..... 29/132

[58] Field of Search ..... 29/131, 132, 130

[56] References Cited

U.S. PATENT DOCUMENTS

| | | | |
|---|---|---|---|
| 2,278,424 | 4/1942 | Campbell | 29/131 |
| 2,312,853 | 3/1943 | Toland et al. | 29/131 |
| 2,927,346 | 3/1960 | Hill | 29/132 X |
| 3,184,355 | 5/1965 | Brown | 29/131 X |
| 3,418,935 | 12/1968 | Adams | 29/132 X |
| 3,445,906 | 5/1969 | Mitchell | 29/131 X |
| 3,475,803 | 11/1969 | Hill | 29/132 |
| 3,714,693 | 2/1973 | Peterson | 29/132 |

*Primary Examiner*—Alfred R. Guest

*Attorney, Agent, or Firm*—Burgess, Dinklage & Sprung

[57] ABSTRACT

A roller for transferring a liquid-based medium, comprising a foundation body non-affinitive for said medium, an intermediate layer firmly bonded to said foundation body, and an uninterrupted very thin elastic coating firmly bonded to said intermediate layer, said coating having an affinity for said medium. The intermediate layer can be a polymeric sheet or film or preferably a textile material such as flock or especially a woven, knit or non-woven fabric. If the roller is intended to transfer aqueous media the coating may contain hydrophilic additives or comprise a polymer with hydrophilic functional groups; for oily media, oleophilic properties are required.

11 Claims, No Drawings

TRANSFER ROLLER

The invention relates to transfer rollers which, used in printing machines as ink rollers or as part of an inking device, transfer a medium in more or less liquid form, such as for example dispersion, solutions, lacquers, printing inks or melts. Ink rollers transfer the liquid medium to the object to be coated or printed on, or to a form. Within an inking system the transfer takes place to an additional roller. A special example of transfer rollers is their use as water rollers. They are used in particular for lithography and offset printing. Water rollers should be still softer than ink rollers and be capable of storing water. They mostly have a foundation of very soft, elastic natural or synthetic rubber and an absorbent cloth covering of cotton or similar material which is pulled over the roller in the form of a seamless tube with a butt joint, or is in the form of strips spirally wound on the roller body. During the first time in operation the cloth covering sheds "lint" that affects the quality of the impression and wears off the printing plates. Also water rollers with a covering of fine-pored highly elastic sponge rubber synthetic materials, for example foamed polyvinyl chloride, have not been successful. With these coverings it is difficult to maintain tolerances in size and an economical water flow, as too large quantities of water lead to difficulties in maintaining the color tones as well as to water streaks. The transfer of too much water leads to an expansion of the paper and consequently an enlargement of the surface which causes difficulties in matching. The same drawbacks are found with coverings of water rollers made of an absorbent, fine-pored material derived from hydrophilic high molecular weight materials which are insoluble in water, for instance fiber-reinforced viscose sponge fabrics. Also inking or water rollers with a nonwoven fabric covering, impregnated with an expansible binding agent and ground after gelatinizing, are as absorptive in relation to water and moistening solutions as in relation to a hydrophobic printing ink. Here, for the mechanical transfer of the media, the roughened surface provided with a web and produced by a final grinding treatment is of decisive importance. Another way to regulate the mechanically transferable quantity of liquid by means of the surface structure is to grind a covering of finepored foam material in such a manner that the pores are open outwards. The exposed pores are then coated with a thin cohesive anti-adhesive film in order to make the surface water repellent and to prevent a penetration of the moisture through the covering.

It has further been attempted to modify the hydrophobic surface of the soft natural or synthetic rubber rollers in such a manner that the surface acquires a greater affinity for the medium to be transferred. Affinity means a certain chemical relationship in the sense of the mutual solvation or dissolution which then also has, however, at the same time the disadvantage that the rubber of the roller swells up because of the dissolving effect which affects the accuracy of size. It has furthermore been attempted to modify the flexible rubber body of water rollers by the working-in of hydrophilic or polar elastomers. As these cannot be worked homogeneously into the main elastomeric part of the rubber body and are present as separate micro-areas which swell up differently, the surface of the roller very soon shows an appearance designated as "orange peel". A similar inhomogeneity is shown by rollers with added hydrophilic fibrous materials, to which also hydrophilic softening agents may have been added. Other hydrophilic fillers, such as for example precipitated silicic acids or metal hydroxides cannot, owing to the enclosure with the rubber material, become effective as long as their content is not very high. With a high hydrophilic material content, however, the properties of the rubber roller body are again negatively affected. If such substances are spread on or built on the surface of the roller by chemical reactions in situ, they are worn off too fast in operation and the hydrophilic coating then has to be replaced in shorter periods, for example every 24 hours. The disadvantage of the rapid wear also applies in cases where the surface of the roller body is modified by chemical after-treatment, such as for example bromination, iodization or oxidation.

In all cases it remains difficult to bind a sufficiently strong and consequently durable layer of affinitive material to the non-affinitive foundation body. The foundation body of soft rollers should be chemically resistant and keep its size accurately. Therefore it preferably consists of rubber or synthetic materials which do not have an affinity for the media to be transferred and are not affected by them. With the non-affinitive foundation bodies and the affinitive surface desired for the transfer it is accordingly a question of chemically incompatible materials which will not bind with each other and therefore do not satisfy the high requirements to be med by transfer rollers in printing machines, in particular water rollers.

The invention is concerned with the problem of preventing the disadvantages mentioned of known rollers and of producing transfer rollers which have a surface specifically affinitive for the medium to be transferred and, in the case of water rollers, have no affinity for oil-based printing inks. Further they should transfer a constant but precisely adjustable film of the medium. If there is only a question of a correspondingly active surface layer, then this should be firmly bound to the foundation body and retain its transfer properties after a long time of operation. Furthermore the rollers should maintain for a long time the tolerances in size which are very close for transfer rollers, stay exactly cylindrical and should not release any material such as "lint".

The subject of the invention is a transfer roller with a non-affinitive foundation body as known, an elastic intermediate layer firmly bound to the foundation body and a cohesive very thin affinitive film or coating firmly adhering to this layer.

By the intermediate layer is meant a relatively thin layer betwen the foundation body and the film-like coating, and which, due to its chemical properties, insures a secure union of these layers which are as a rule chemically incompatible. The intermediate layer should be chemically so constituted that it can enter into a secure bond with the coating and the foundation body. As the transfer properties of the roller according to the invention are determined exclusively by the very thin cohesive affinitive coating and not by the chemical nature of the intermediate layer, since this is completely covered by the coating, a material may be selected for the intermediate layer which determines the structure of the surface, maintains its size and is chemically resistant.

The mechanical properties of the roller are chiefly determined by the foundation body. This consists mainly of metal or synthetic materials with an elastic covering layer with a hardness between about 15 and 45 Shore A, while they may have higher hardnesses up to about 80 Shore A with laminating or wax application rollers. In special cases the foundation body may also be hard elastic and consist of metal or hard synthetic materials. Foundation bodies of the various hardnesses for the different purposes are known. The hardness or the softness of the transfer rollers according to the invention is essentially determined by these known foundation bodies, for the intermediate layers according to the invention may be remarkably thin and may have for example a thickness of about 10 μm. If the intermediate layer is a sheet or a film of an organic polymer, it has a thickness of about 0.1 to 1 mm, preferably about 0.05 to 0.5 mm. The elasticity of the intermediate layer becomes particularly important when this lies in the higher range of the thickness indicated. In addition to the chemical properties required, the material of the intermediate layer should therefore be able to give way to a compression or tensile stress and automatically return to the original form after the stress is gone. The elasticity can be obtained either by the characteristics of the material as such, for example rubber elastic, or also by the structure of a, for example, extensible cloth or non-woven fabric. The intermediate layer can be applied as a sheet, or can be produced by dipping or similar known methods of application, for example from plastisols, pastes or plastigels, particularly derived from polyvinyl chloride emulsion or suspension polymerizates. It is also possible to use as an intermediate layer laminated or multilayer sheets consisting for example of a combination of polyethylene with polyamides, polyesters, polyvinylidene chloride, polypropylene, cellulose, glass, etc. In the case of the two polymers being of a different chemical character, a good compound binding can be obtained by treatment with halogen or adhesive agents during the production of multilayer sheets. One side of such a compound sheet can then be firmly bound to the foundation body, while the other side guarantees a good binding to the covering layer.

If a sheet enters into a good binding with the foundation body but not with the covering layer, it is possible to so modify the side facing the covering layer by a known chemical treatment that here too a good binding is guaranteed. The same applies in reversed a reversed manner if the sheet owing to its chemical properties can be adequately bound to the covering layer but not to the foundation body.

Another possibility is to produce the intermediate layer from fibrous textile material. For the purposes of the invention this means all that can be produced from natural or synthetic fibers. Appropriate fibrous materials of an organic nature are for instance polyamides, polyacrylonitrile (acrylics), polyesters, polyimides, polyvinyl alcohol, polyvinyl acetate, hair, wool, silk, cellulose, regenerated cellulose, cellulose acetate, cellulose nitrate, cellulose butyrate, rayon, linen, cotton or hemp. Inorganic fibrous materials are suitable as well for the material of the intermediate layer for purposes of the invention. Among these are for example mineral fibers, glass fibers, metal fibers or carbon fibers. The different textile materials of the intermediate layer may be fabric, meshed products, for example woven or knit goods, non-woven fabrics or layers produced by flocking. These intermediate layers of fibrous textile material have a minimum thickness of about 0.02, preferably about 0.05 mm, and a maximum thickness of about 2, preferably about 0.5 mm. Also thick intermediate layers, for example up to about 5 mm, are usable without, however, having particular advantages.

If necessary, synthetic fibers should still be made readily susceptible to rubber by means of impregnating agents known in the art. Similar to what has been outlined above for compound sheets, non-woven fabrics may also consist of mixed fibers, of which a portion owing to their affinity for the foundation body affords firm binding thereto, while another portion of the fibers makes possible a firm binding to the coating. Textile foundations of chemically uniform fibers as well as fiber mixtures can, as described above with regard to sheets, also be modified, e.g. made susceptible to rubber, on one side by a chemical treatment in order to improve the binding to the foundation body or the covering layer. In certain cases it is also conceivable with bases in textile or sheet form to treat both sides differently to improve the binding to the underlayer or the covering layer.

Regardless of whether the intermediate layer consists of fibrous textile material or whether it has the form of a sheet or film, it is necessary to see to a firm binding of the intermediate layer to the foundation body. This is preferably done by means of vulcanization or by using an adhesive. If for instance the intermediate layer consists of natural cellulose fibers, then it can form by vulcanization a firm bond with almost any of the elastomers commonly used for the foundation body. In this process the intermediate layer is directly bound by vulcanization to the as yet unvulcanized foundation body; thus the bond is not obtained by means of an additional adhesive. It is useful when vulcanizing to press the intermediate layer with some pressure on the foundation body. This may be realized for instance by evenly covering the foundation body, finished to gauge, with the intermediate layer, and producing the pressure either by a fully enclosing metallic form or by winding form-giving tapes around it. The vulcanization can in general be effected by the crosslinking agents commonly used for the respective materials, such as sulfur, peroxides, radicals or energy-bearing rays.

When using an adhesive, an adhesive layer is applied to the foundation body in such a thickness that a suitable bond can be achieved. The actual attachment can be obtained by means of known adhesive systems which either are not chemically changeable, or cross-link, at room or a higher temperature, by a process similar to vulcanization. Examples of reactive adhesives are epoxy, isocyanate, phenolic, cyanoacrylate, melamine or urea adhesives. The very thin affinitive film or coating ultimately responsible for the transfer qualities of the roller adheres firmly to the intermediate layer and covers it completely, so that the material of the intermediate layer has chemically no influence on the transfer process. The coating is so constituted that it has an affinity, i.e. chemical relationship, in relation to the medium to be transferred. It reduces the interfacial forces between the medium to be transferred and the surface, and favors thereby the transfer operation. This can be best described by taking water as an example. A surface non-affinitive for water has the effect that, owing to its surface tension, water assumes as much as possible a spherical shape. By using an affinitive coating a very good distribution of the water is obtained. This makes it possible to transfer a very thin layer of water in constant expansion. The same applies also to the transfer process of other media, although here the appearances cannot so easily be detected with the naked eye because of higher viscosity than that of water. Thus in the case of water the coating according to the invention facilitates the transfer, and allows the reduction of the additives which are usually to be added to the water to reduce the surface tension. The affinitive coating according to the invention makes it possible that in dampening devices only the minimum desired quantity of water corresponding to the requirements of the printing technique is transferred. A most economical "water flow" is therefore possible. This is of great importance in offset printing in order to maintain the color tones and to avoid water streaks and difficulties in matching. Owing to the very hydrophilic surface, the water distribution is so favorably affected that the rest of the quantity of water is evenly spread and no water streaks occur. Water rollers according to the invention accordingly have a wide range of tolerance between a very low smear limit and a high water-streak limit. By having affinitive, oleophilic coatings according to the invention, it is possible in inking devices to clearly improve the ink distribution and to obtain the following of a thinner film of ink. The affinity of the coating for the medium to be transferred is obtained either if the affinitive coating contains organic polymers with functional groups giving it the affinity or if affinitive components are added to the film-forming elastic material of the coating. If the rollers are intended for the transfer of aqueous media, then the coating contains in accordance with the invention hydrophilic additives or organic polymers with hydrophilic groups. As indicated at the beginning, hydrophilic additives as such are known. They may be present in very high concentrations in the covering layer according to the invention, as the coating itself is very thin and thus is not determinative for the elasticity and "softness" of the roller. Appropriate hydrophilic additives are for example hydrophilic fibrous materials, for instance cotton, wool, linen, jute, hemp, cellulose derivatives such as viscose or snythetic wool, polyvinyl acetates or polyvinyl alcohols, and also hydrophilic inorganic fillers such as silicic acid, hydrated silicates, metallic hydroxides and isopoly acids. Another possibility for making the coating hydrophilic is to chemically modify the organic polymers of the coating by means of hydrophilic, in particular polar, groups such as hydroxyl, carboxyl, sulfate, sulfonate or ethyl groups. A hydrophilizing process can furthermore be achieved by "silanization" with bifunctional silanes of the $R'Si(OR)_3$ type, in which R' indicates reactive organic substituents and OR indicates alkoxy groups, and subsequent hydrolysis, for instance with a diluted solution of caustic soda. The chemical groups which by their structure within polymers afford them hydrophilic or hydrophobic properties, are sufficiently known from the corresponding modification of synthetic fibers, from wetting agents or from hydrophobizing agents.

The rubber body of transfer rollers is in effect usually hydrophobic or oleophilic because of the rubber material used, but for certain purposes these properties are not sufficient, or they can specifically be adapted to the medium to be transferred. If there are contained in the coating material chemical groups similar to those in the medium to be transferred, the coating becomes very affinitive for the medium. For example, a coating of styrene-butadiene rubber with a high styrene content shows a high affinity for aromatics. The coating of rollers for the transfer of oil or varnish-based media is receptive to oleophilic additives such as polyolefin, or organic polymers with oleophilic groups such as aliphatic chains.

The coatings according to the invention are remarkably thin. They have a thickness of about 10 to 500 μm, preferably about 30 to 200 μm. They are produced on the film or on the fibrous material of the intermediate layer by applying solutions or dispersions of polymers. It is also possible to apply monomers or oligmers, possibly mixed with polymers, to subsequently polymerize during or after surface drying. If the property desired of the coatings is based on affinitive additives, for example hydrophilic or oleophilic additives, the polymeric material only serves as carrier for these additives. By virtue of the chemical relationship of the coating material to the intermediate layer, a firm binding or attachment of the affinitive coating to the intermediate layer is guaranteed. While the transfer roller may still have on the surface the fibrous structure of the intermediate layer, the only decisive factor is, however, that the material of the intermediate layer is completely enclosed by that of the coating. This closed, very thin affinitive film should not be removed afterwards, for example by grinding. If, in a particularly preferred embodiment, the intermediate layer consists of a coat of fibers perpendicular to the surface, so that the surface of the roller has a velvet or flock character, it then depends on the quantity of the enclosing coating whether this only envelops the free-standing fibers and fixes them additionally at their base, or whether the coating fills up for the most part the spaces between the fibers which can be done to the extent that the fibers only still serve as an additional binding of the externally smooth coating.

Due to the reduced thickness of the coating the disturbances, usually occurring at the swelling of affinitive ingredients in a thick layer, have been reduced to such an extent that they practically do not appear in the geometrical form nor in the surface structure.

The invention will be further described in the following illustrative examples.

EXAMPLE 1

An appropriate adhesive is applied to a foundation body accurately turned to gauge and consisting of a metallic core with an elastic rubber coating with a hardness of 25 Shore A made of nitrile-butadiene rubber firmly vulcanized on it in a usual manner.

The diameter of the accurately maintained size of the foundation body is by 0.25 mm below the finished size, as the coat will be increased by 0.125 mm, and consequently the diameter will be enlarged by 0.25 mm, by the intermediate layer and the coating.

A non-woven fabric consisting of a pure polyester fiber (weight per $m^2$: 75 g) is, in adjacent axial position and overlapping, firmly wrapped around the still adhesive layer of adhesive substance.

After complete drying of the adhesive the overlapping seam is accurately ground off.

An ethylene-vinylacetate copolymer dispersion, that can be thermally cross-linked, is then evenly applied in two stages by means of a spreading knife in such a manner that a coating having a thickness of about 0.025 mm is formed ($=50 g/m^2$ solid matter).

By means of heating by circulating air at 130° C for 20 minutes both the adhesive and the coating are chemically cross-linked.

The transfer roller now consists of the non-affinitive foundation body, an intermediate layer of 0.1 mm and the hydrophilic coating of about 0.025 mm.

This transfer roller is eminently suitable to transfer water or aqueous media as well as alcohols or media containing alcohol, for example dampening solutions in dampening devices or water tank lacquers or alcohol-based inks (flexographic or aniline printing inks).

EXAMPLE 2

An adhesive mixture of a chlorobutadiene adhesive with a cross-linking agent is applied to a foundation body turned to gauge and consisting of a metallic core with, firmly vulcanized thereon, an elastic rubber coating of a hardness of 60 Shore A of a heat resistant nitrile butadiene rubber.

The diameter of the precisely maintained size of the foundation body is by 0.6 mm below the finished size, as the coat is increased by 0.3 mm, and consequently the diameter is enlarged by 0.6 mm by the intermediate layer and the coating.

A ready-cut tape of glass fiber fabric (weight per $m^2$: 42 g) with accurately fitting edges, that has been susceptible to rubber, is once spirally wrapped in a known fashion around the still adhesive layer of adhesive substance.

After complete drying of the adhesive, a silicone past vulcanizing at room temperature is evenly spread on, so that the total thickness of intermediate layer and coating amounts to 0.3 mm.

The cross-linking reaction proceeds by means of storage for 24 hours at room temperature.

The transfer roller now consists of the foundation body, an intermediate layer of about 0.02 mm and the coating of 0.28 mm.

Owing to its nonpolar hear resistant and elastic coating, this transfer roller is eminently suitable for transferring in coating machines melts of waxes (hot melts), adhesives or silicones at high temperatures.

EXAMPLE 3

By means of a spray gun an even layer of a conductive adhesive is applied to a foundation body prepared in accordance with Example 1.

A polyamide cut flock (length 0.5 mm; 6 den.) is applied in a known manner by electrostatic flocking. There occurs a velvet-like coating. The adhesive cross-links by the moisture in the air. After complete drying of the adhesive, fiber surpluses are removed by brushing and aspiration. The textile surface is now impregnated by spreading on a styrene-butadiene rubber latex mixture. This dispersion has a solid matter content of about 48%.

Owing to its nonpolar coating, this transfer roller is eminently suitable for transferring inks derived from nonpolar binding agents, for instance mineral oilbased printing inks or lacquers derived from nonpolar solvents, for instance aliphatic hydrocarbons such as benzines.

EXAMPLE 4

A metallic core is covered in a known manner with a rubber mixture of chlorobutadiene and subsequently turned so that its size in diameter is 0.62 mm below the finished size. A cotton fabric of 0.30 mm thickness is now spirally wrapped around in a known manner, the edges fitting accurately. Subsequent vulcanization by means of an accurately fitting form in a vulcanizing press firmly binds the fabric to the rubber which has a hardness of 15 Shore A.

After vulcanizing, a solution of a methacrylate lacquer containing OH groups is three times spread onto the fabric and then dried at room temperature, so that a coating of 0.01 mm is formed.

The coating roller now consists of the vulcanized foundation body, an intermediate layer of 0.30 mm and the coating of 0.01 mm.

Due to its hydrophilic coating, this coating roller is eminently suitable for use as a water roller or with other aqueous media.

EXAMPLE 5

By means of an appropriate adhesive a laminated sheet of 0.5 mm thickness consisting of polyamide and polyethylene is attached to a foundation body accurately turned to gauge and consisting of a metallic core with, firmly vulcanized thereon in a known manner, a rubber coating of a hardness of 80 Shore A composed of acrylonitrilebutadiene rubber.

The diameter of the accurately maintained size of the foundation body is by 3.0 mm below the finished size, as the intermediate layer and the coating increase the total coat by 1.0 mm, so that the diameter is enlarged by 2.0 mm. After drying of the adhesive, a solution of an ethylene propylene diene rubber mixture is spread on so often that a coating of 0.5 mm is formed. After evaporation of the solvent, vulcanization is performed as usual.

The transfer roller now consists of the foundation body, an intermediate layer of 0.5 mm and a coating of 0.5 mm.

This transfer roller is eminently suitable for transferring media with nonpolar solvents such as ink derived from benzines or oils.

EXAMPLE 6

An appropriate adhesive mixture is applied to a foundation body accurately turned to gauge and consisting of a metallic core with rubber of a hardness of 40 Shore A of natural rubber firmly vulcanized thereon in a known manner.

The accurately maintained size of the foundation body is in diameter by 3.0 mm below the finished size, as the intermediate layer and the coating add by 1.5 mm to the total coating, so that the diameter is enlarged by 3.0 mm.

A non-woven fabric consisting of cellulose fibers and polyester fibers (weight per $m^2$: 100 g) is, the edges precisely fitting, spirally wrapped around, and firmly against, the still adhesive layer of adhesive substance.

After drying of the adhesive, a liquid mixture consisting of a polyester, adipic acid, diethylene glycol and toluylene diisocyanate is applied to the intermediate layer by repeated dipping, so that a coating of 0.5 mm is formed.

Both the adhesive and the coating are chemically cross-linked by heat treatment at 130° C in 30 minutes. The coating then consists of a polyurethane elastomer.

The transfer roller is now composed of the foundation body, an intermediate layer of 1.0 mm and the coating of 0.5 mm.

This transfer roller is eminently suitable for transferring dissolved inks or lacquers of low molecular weight esters and/or ketones, as they are used for example in flexographic printing.

EXAMPLE 7

A polyester non-woven fabric of about 0.3 mm thickness is attached by a reactive adhesive to a rubber roller for the dampening device of an offset press. Thereupon an acrylate dispersion of about 50% solid matter content, wherein there was dispersed 10 to 15% aluminum hydroxide, is evenly spread on. After drying, the roller is heated to 120° C for the necessary condensation and resultant hardening of the layer of synthetic material. The roller thus produced has a hydrophilic coating insoluble in water on the intermediate layer consisting of polyester non-woven fabric.

The Table shows further possible combinations according to the invention which, however, are illustrative rather than limiting.

The elastomer or synthetic resin basis of the foundation body is indicated in the second column. The third column contains details about material basis and kind of intermediate layer, with which, if necessary, the lower side of this intermediate layer can be made susceptible to the material of the foundation body by a corresponding, known treatment and/or the upper side can be made susceptible to the coating by treatment.

The fourth column indicates the elastomer or synthetic resin basis for the affinitive coating. Consisting of for example dispersions, solutions, pastes or melts, it is applied by spreading on, spraying, dipping or similar method of application.

The final column indicates purposes for which the roller according to the invention is eminently suitable.

Table

| Example | foundation body | intermediate layer lower side upper side | coating | transfer roller for |
|---|---|---|---|---|
| 8 | acrylonitrile-butadiene rubber 20–60 Shore A | polyacrylonitrile cellulose fabric | butyl rubber | nonpolar solvents (benzine, oils) |
| 9 | " | polyamide cellulose fabric | " | " |
| 10 | " | polyacrylonitrile polyolefin fabric | ethylene propylene diene rubber | " |
| 11 | ethylene propylene diene rubber 20–60 Shore A | polyolefin polyester fabric | polyurethane | polar solvents (esters, ketones) |
| 12 | " | polyolefin cellulose fabric | hardened gelatin | aqueous media |
| 13 | " | polyolefin cellophane laminated sheet | " | " |
| 14 | " | polyolefin polyamide fabric | acrylonitrile butadiene rubber | polar solvents |
| 15 | acrylonitrile-butadiene rubber 60–90 Shore A | glass fiber fabric with under side susceptible to rubber | silicone | melts of waxes, silicones |
| 16 | polyamide 100 Shore A | polyacrylonitrile-polyvinyl alcohol fabric | hardened gelatin | aqueous media |
| 17 | brass | cellulose fabric | styrene-butadiene | nonpolar solvents |
| 18 | sulfochlorinated polyethylene | polyolefin polyamide fabric | acrylonitrile butadiene rubber | aromatics |
| 19 | " | polyolefin cellulose fabric | styrene-butadiene rubber with high styrene content | " |

It will be appreciated that the instant specification and examples are set forth by way of illustration and not limitation, and that various modifications and changes may be made without departing from spirit and scope of the present invention.

What is claimed is:

1. A roller for transferring a liquid-based medium, comprising a foundation body non-affinitive for said medium, an intermediate layer firmly bonded to said foundation body, and an uninterrupted very thin elastic coating firmly bonded to said intermediate layer and chemically different therefrom, said coating having an affinity for said medium and non-affinitive for said foundation body.

2. A roller according to claim 1, wherein, the intermediate layer is attached to the foundation body by vulcanization or by use of an adhesive.

3. A roller according to claim 2, wherein said foundation body comprises a steel core covered with a relatively thick rubber layer of a hardness between about 15 and 45 Shore A, the intermediate layer comprises fibrous textile material having a thickness of about 0.05 to 0.5 mm, and the thin elastic affinitive coating has a thickness of about 30 to 200 μm and comprises an organic polymer with affinitive functional groups.

4. A roller according to claim 1, wherein the intermediate layer comprises fibrous textile material.

5. A roller according to claim 4, wherein the textile material is a woven, knit or non-woven fabric or is a layer of flock.

6. A roller according to claim 4, wherein the intermediate layer has a thickness of 0.02 to 5 mm.

7. A roller according to claim 1, wherein the intermediate layer comprises an organic polymer sheet or film.

8. A roller according to claim 7, wherein the intermediate layer has a thickness of about 0.01 to 1mm.

9. A roller according to claim 1, wherein the affinitive coating comprises an organic polymer with affinitive functional groups.

10. A roller according to claim 9, wherein the coating has a thickness of about 10 to 500 μm.

11. A roller according to claim 1, wherein the intermediate layer is a woven, knit or non-woven textile fabric or an organic polymer sheet or film and has a thickness of about 0.05 to 0.5 mm, and said coating has a thickness of about 30 to 200 μm.

* * * * *